US006286571B1

(12) United States Patent
Wiklund

(10) Patent No.: US 6,286,571 B1
(45) Date of Patent: Sep. 11, 2001

(54) PROCESS FOR SAWING LOGS

(76) Inventor: Martin Wiklund, Mosstorpsvägen 40, S-183 30 Täby (SE)

( * ) Notice: Subject to any disclaimer, the term of this patent is extended or adjusted under 35 U.S.C. 154(b) by 0 days.

(21) Appl. No.: 08/108,698

(22) PCT Filed: Mar. 17, 1992

(86) PCT No.: PCT/SE92/00164

§ 371 Date: Sep. 3, 1993

§ 102(e) Date: Sep. 3, 1993

(87) PCT Pub. No.: WO92/16339

PCT Pub. Date: Oct. 1, 1992

(30) Foreign Application Priority Data

Mar. 19, 1991 (SE) ..... 9100830

(51) Int. Cl.[7] ..... B27C 9/00

(52) U.S. Cl. ..... 144/378; 144/345; 144/346; 144/347; 144/355; 144/359; 144/360; 144/363; 144/376

(58) Field of Search ..... 144/345, 346, 144/347, 355, 359, 360, 363, 376, 378, 367; 83/75.5, 13, 44, 47

(56) References Cited

U.S. PATENT DOCUMENTS

| | | | | |
|---|---|---|---|---|
| 186,893 | * | 1/1877 | Springer | 144/378 |
| 781,376 | | 1/1905 | Sorensen | 144/346 |
| 3,961,654 | | 6/1976 | Hasenwinkle | 144/348 |
| 4,239,069 | * | 12/1980 | Zimmerman | 144/376 X |
| 4,846,237 | * | 7/1989 | Wolf | 144/378 X |
| 5,299,400 | * | 4/1994 | Sing | 144/347 X |

FOREIGN PATENT DOCUMENTS

| | | | | |
|---|---|---|---|---|
| 497432 | | 5/1930 | (DE) . | |
| 524031 | | 10/1930 | (DE) . | |
| 89698 | * | 9/1960 | (DK) | 144/346 |
| 388507 | | 9/1990 | (EP) . | |
| 81986 | | 9/1990 | (FI) . | |
| 434053 | * | 8/1935 | (GB) | 144/346 |
| 833617 | * | 4/1960 | (GB) | 144/367 |
| 47-31299 | | 11/1972 | (JP) . | |
| 49-116206 | | 6/1974 | (JP) . | |
| 1186474 | * | 10/1985 | (SU) | 144/359 |
| 1242351 | * | 7/1986 | (SU) | 144/378 |
| 93/08000 | * | 4/1993 | (WO) | 144/363 |

* cited by examiner

*Primary Examiner*—Clark F. Dexter
(74) *Attorney, Agent, or Firm*—Hollander Law Firm, P.L.C.

(57) ABSTRACT

The invention relates to a method of sawing a log in order to provide a high yield of vertical-grained pieces of lumber. According to the invention, this is achieved by sawing from the log not only pieces of lumber which are triangular or sector-shaped in cross-section but also essentially plane-parallel boards between adjacent pairs of the pieces which are triangular or sector-shaped in cross-section.

1 Claim, 2 Drawing Sheets

PROCESS FOR SAWING LOGS

Figure 1:
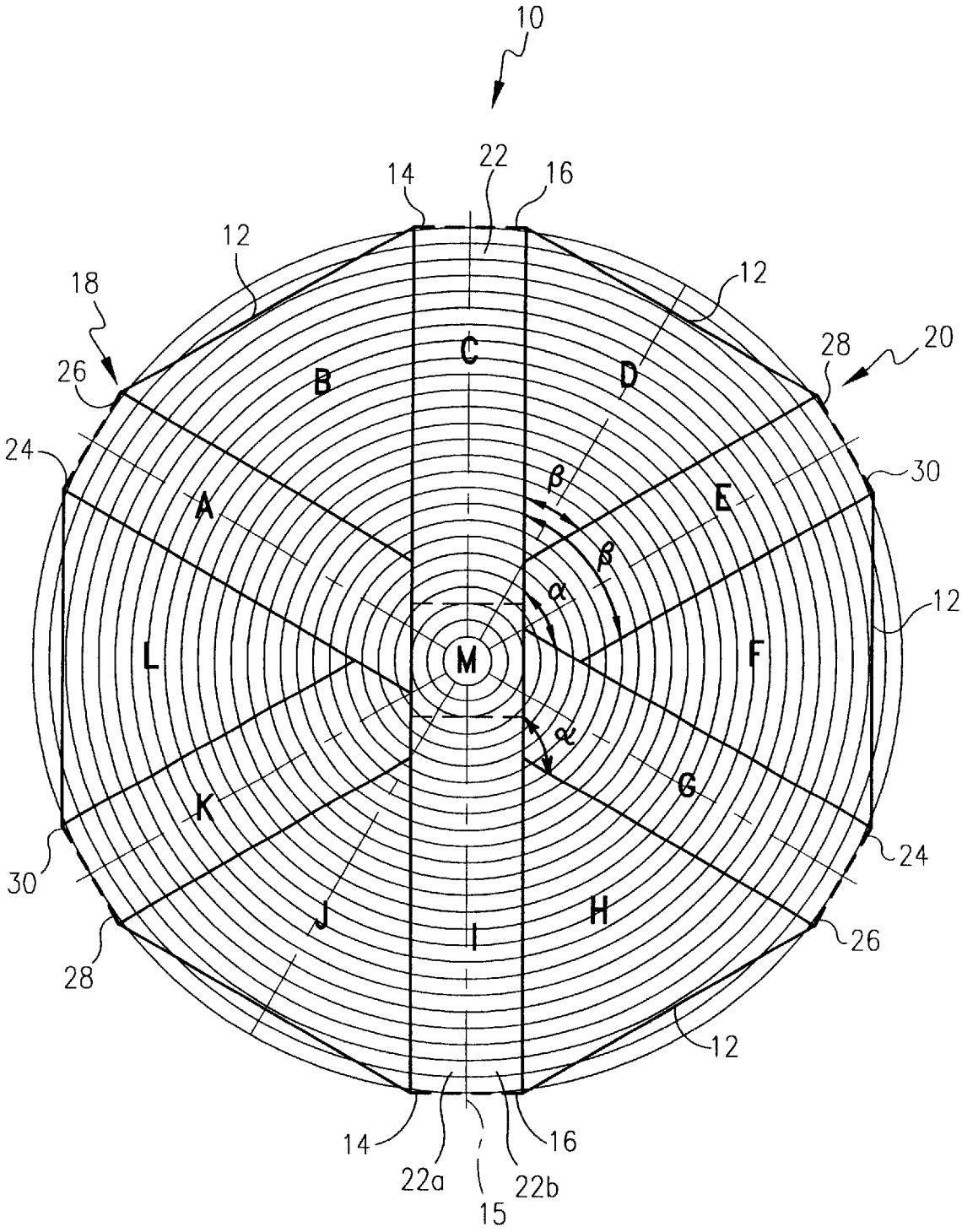

The present invention relates to a method of sawing a log for high yield extraction from the log of vertical-grained lumber, i.e. pieces with growth rings more or less perpendicular to the widest surfaces of the cut piece.

It is common practice, for special uses of wood, that it is desirable to extract vertical-grained lumber, i.e. pieces of lumber which are sawn out essentially radially to the log. Vertical-grained lumber is less susceptible to cracking when dried and does not cup but remains planar and has less of a tendency to become warped and twisted and have other defects caused by contraction anisotropism in the wood substance. Surfaces which are been cut radially into a log are harder than tangentially cut surfaces. Furniture, floors and other woodwork are of recognized higher quality if the wood used is vertical-grained.

An older method of obtaining vertical-grained lumber is so-called quarter sawing. The yield used in this method is, however, low, and only certain pieces of lumber are vertical-grained when this method is used.

DE-C-692 987 describes a method of manufacturing an intermediate layer from plywood or similar products with vertical-graining, whereby a log is sawn with radial, longitudinal cuts into a plurality of sector- or wedge-shaped pieces of lumber, which, after tangential edging are glued together in blocks in which the wedges alternate. From the block there can then be sawn planks or sheets with vertical-graining.

WO 89/04747 describes a method of sawing logs where they are sawn with longitudinal radial cuts into wedge-shaped vertical-grained pieces of lumber.

The lumber yield when sawing with these two methods described immediately above is rather good.

Practically all of the lumber obtained according to these two methods must be glued prior to use. This is expensive and sometimes technically or aesthetically unsatisfactory.

A primary purpose of the present invention is to extract from logs, primarily logs of intermediate or large diameter, i.e. logs with a diameter of about 18 cm and above, an improved yield of vertical-grained pieces of lumber. In principle, this is achieved according to the invention by sawing out pieces of not only triangular or sector-shaped cross-section but also planks with essentially parallel sides between adjacent pairs of the triangular or sector-shaped pieces. Specifically, the log is divided with at least two parallel, longitudinal and nearly diametrical cuts, which are parallel to the pith, to obtain at least one essentially diametrical and plane-parallel board and a pair of blocks with substantially semi-circular cross-section and, with parallel, substantially radial, longitudinal cuts, which are substantially parallel to the pith, dividing each of the blocks into at least three pieces of lumber which are essentially sector-shaped or triangular in cross-section and at least one substantially plane-parallel board between adjacent pairs of the pieces of lumber which are sector-shaped or triangular in cross-section. This method of sawing provides, especially for big logs, improved yield of vertical-grained lumber which can be used as raw material for high quality construction, wood-working and furniture products.

According to a preferred embodiment of the method according to the invention, the blocks divided with the parallel, nearly radial cuts are spaced at 60° angular intervals to extract from an essentially round log six substantially uniform pieces of lumber having a cross-section which is an equilateral triangle after tangentially edging of each piece of lumber, and at least five essentially plane-parallel boards. By virtue of the division of the log into six pieces, each having a cross-section which is an equilateral triangle, they can, after drying, be either glued together to either be rip sawn in a manner known per se into desired products, preferably vertical-grained, or be used for flooring, counters or the like where an end-grained working surface is desired.

It is suitable to divide the essentially diametrical piece of lumber into at least two parts by removing the pith with the central, undesirable juvenile wood.

For very large logs, it can be suitable to extract from between each pair of sector-shaped or triangular pieces of lumber a plurality of essentially radial, plane-parallel boards.

According to a preferred embodiment, the planar supporting surfaces on the outer surface of the log are prepared prior to division of the log, said supporting surfaces being the external sides of the pieces with triangular cross-section. These supporting surfaces can also be used to guide the log during continuing sawing.

Figure 2:
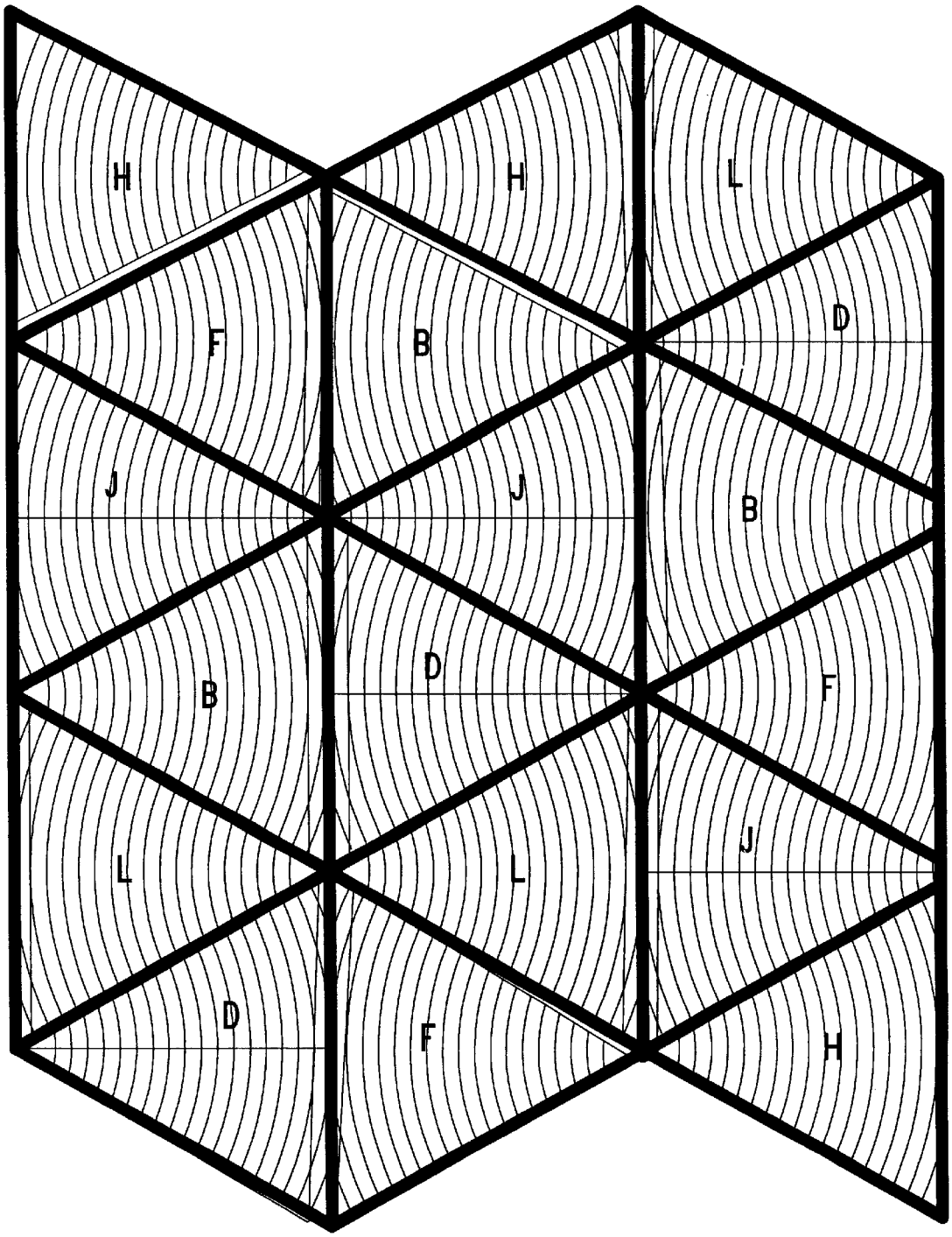

The invention will be described in more detail below with reference to the accompanying drawings, in which:

FIG. 1 shows a cross-section through a log with a sawing pattern in accordance with the present invention, and FIG. 2 shows a composite of triangular pieces of lumber into a block.

In FIG. 1, a sawing pattern for the method according to the present invention is shown. In the embodiment shown, a log 10 is first edged to obtain supporting surfaces 12 for the six triangular pieces B, D, F, H, J, L, which are to be sawn out of the log. The log 10 is divided by means of two parallel, nearly diametrical, longitudinal cuts 14, 16 into two essentially semi-circular blocks 18 and 20, and into a central, plane-parallel sheet 22, which after edging forms a board or plank. This essentially diametrical, plane-parallel board 22 is suitably cut into two pieces C, I as the central unsuitable juvenile wood N is removed.

The two blocks 18, 20 are then divided by two parallel, nearly radial cuts 24 and 26 at an angle $\alpha=120°$ to the cuts 16 and 14, thus obtaining from each block a radial, plane-parallel sheet in the form of an un-edged board or plank G and A, and a piece H and B, the cross-section of which is an equilateral triangle, and a remaining piece, which in turn is divided by two nearly radial cuts 28 and 30 at an angle $\beta=60°$ to the cuts 16 and 14. This provides from each block two additional pieces D, F and J, L, each having a cross-section in the form of an equilateral triangle as well as a radial, plane-parallel sheet E, K. From the log 10 there is thus extracted by this method six essentially identical pieces of lumber B, D, F, H, J and L having a cross-section which is an equilateral triangle and four plane-parallel boards A, E, G and K as well as one diametrical plane-parallel board 22, which can be divided into two parts C and I as the undesirable pith and surrounding juvenile wood M is removed. All of the pieces of lumber obtained by this method of sawing are essentially vertical-grained and the material yield is at the same time high.

For very large logs, it is possible to saw the log with three or more parallel cuts to extract two or more plane-parallel boards between adjacent pairs of triangular pieces of lumber. In FIG. 1, two such boards are indicated by 22*a*, 22*b*, which are obtained by an extra diametrical cut 15.

After drying, the pieces of lumber with a cross-section which is an equilateral triangle can be glued together in a manner known per se into blocks, as shown in FIG. 2, for example, which are then sawn for example with cuts in the plane of the drawing to obtain decorative and durable sheets for a wide variety of uses.

Even though the invention has been described in connection with a particular preferred embodiment for sawing out six pieces each in cross-section in the form of an equilateral triangle and five or six plane-parallel sheets therebetween, all with vertical-graining, it is also possible within the scope of the invention and with an equally high yield to saw the log into eight, twelve or more triangular or wedge-shaped pieces with plane-parallel sheets between each pair of triangular or wedge-shaped pieces of lumber.

What is claimed is:

1. A method of sawing an essentially round log for high-yield extraction from the log of vertical-grained lumber, comprising the steps of dividing the log with at least two parallel, longitudinal and substantially diametrical cuts, which are parallel to a central pith to obtain at least one essentially diametrical and plane-parallel board and a pair of blocks with substantially semi-circular cross-section and wherein the side of each of said blocks adjacent to said at least one plane-parallel board is planar, dividing each of the blocks into five pieces of lumber, such that three of said pieces are essentially triangular in cross-section and two are essentially plane-parallel boards, wherein said step of dividing each of the blocks is performed by sawing each of said blocks with two pairs of parallel substantially radial, longitudinal cuts substantially parallel to the pith and spaced at 60° angular intervals, and dividing each essentially diametrical and plane-parallel board into two plane-parallel boards with two transverse cuts while moving central juvenile wood therebetween so as to extract from said essentially round log six substantially uniform pieces of lumber having a cross-section which is an equilateral triangle after a subsequent tangential edging of a peripheral surface of said pieces of lumber essentially triangular in cross-section, and at least six essentially plane-parallel boards, wherein two of said at least six essentially plane-parallel boards each have a planar edge surface that angles 60° to one side surface of the same board, and another two of said at least six essentially plane-parallel boards each have a V-shaped edge portion having two planar edge surfaces, each of which form a 120° angle with two plane-parallel side surfaces of the same board and form a 120° angle between each other.

* * * * *